United States Patent [19]

Odagawa

[11] Patent Number: 4,709,128

[45] Date of Patent: Nov. 24, 1987

[54] EASILY POSITIONABLE KEYBOARD

[75] Inventor: Kazuyoshi Odagawa, Yokohama, Japan

[73] Assignee: Canon Kabushiki Kaisha, Tokyo, Japan

[21] Appl. No.: 860,697

[22] Filed: May 5, 1986

Related U.S. Application Data

[63] Continuation of Ser. No. 607,621, May 7, 1984.

[30] Foreign Application Priority Data

May 17, 1983 [JP] Japan ..... 58-84939

[51] Int. Cl.[4] ..... H01H 13/04

[52] U.S. Cl. ..... 200/340; 200/294

[58] Field of Search ..... 200/340, 294, 296, 284

[56] References Cited

U.S. PATENT DOCUMENTS 3,809,838 5/1974 Coppola ..... 200/294
4,453,063 6/1984 Wanatowicz, Jr. et al. ..... 200/340
4,459,439 7/1984 Hehl ..... 200/295

FOREIGN PATENT DOCUMENTS 2352280 11/1974 Fed. Rep. of Germany ..... 200/294
1094014 12/1967 United Kingdom ..... 200/284

OTHER PUBLICATIONS

Harris, R. H.—*Self-Biasing Space Bar Stabilizer Mechanism*—Feb. 1979, IBM Tech. Disclosure—vol. 21—No. 9—pp. 3725-3726.

Harris, R. H.—*Counterweight Space Bar Mechanism*—Sep. 1977, IBM Tech. Disclosure—vol. 20—No. 4—pp. 1536-1537.

*Primary Examiner*—Henry J. Recla
*Assistant Examiner*—Renee S. Luebke
*Attorney, Agent, or Firm*—Fitzpatrick, Cella, Harper & Scinto

[57] ABSTRACT

A keyboard switch comprises a key switch, a key top mounted on the key switch, stress transmission means for transmitting a depression force of the key top to a plurality of areas of the key top, and a common member for supporting the stress transmission means and engaging the key switch.

6 Claims, 8 Drawing Figures

EASILY POSITIONABLE KEYBOARD

This application is a continuation of application Ser. No. 607,621 filed May 7, 1984.

BACKGROUND OF THE INVENTION

1. Field of the Invention

The present invention relates to a keyboard switch of an electronic equipment, and more particularly to a keyboard switch having a rectangular actuation key of a high rectangle ratio.

2. Description of the Prior Art

Various structures have been used in the prior art keyboards of electronic equipments. They are classified into two major categories, one in which a plurality of key switches are arranged and the other in which a plurality of switch patterns are arranged on a printed circuit board and the switch patterns are selectively shorted by depressing keys arranged on the switch patterns. In those structures, the keys are normally biased by springs oppositely to the depression direction, and when the key is to be actuated, it is depressed against the biasing force.

A space key or a shift key of a full keyboard for a typewriter or a computer uses a rectangular key having a rectangle ratio of larger than 1.5. If an end area of such a key is depressed, a rotating moment is created by the biasing force and thus, the key is subject to both the depression force and a force which tends to incline a key shaft provided at center of the key. As a result, if the key switch is arranged at the center of the rectangular key under the key, the keyboard will not be smoothly operated or may be broken during long term use. To avoid the above problem, a torsion bar structure shown in FIGS. 1 and 2 has been used in the prior art rectangular key. FIG. 2 shows a sectional view taken along a line A—A of FIG. 1.

In FIGS. 1 and 2, numeral 10 denotes a known key switch which is fixed to a mounting hole 51 of a keyboard chassis 50 by a flange 14 and a pawl 15. Precise positioning is done by a positioning projection 12 provided at a bottom of the flange 14, which positioning projection is fitted to a positioning hole of the keyboard chassis 50. A terminal 11 is provided at a bottom of the key switch 10 and is soldered to a printed circuit board 60.

A rectangular key 20 is fitted to a stem 13 formed at the top of the key switch 10. Only the key 20 projects from an equipment case, not shown. Torsion bar receptacles 21 are formed at a bottom of the key 20. Ends of a U-shaped torsion bar 30 engage with the torsion bar receptacles. The torsion bar 30 is slidably mounted on a bearing 40 mounted on the keyboard chassis 50. In the structure shown, the key switch 10 contains a biasing mechanism and the torsion bar 30 merely mechanically engages the ends of the key 20.

In this arrangement, when one end of the key 20 is depressed, the depression force is transmitted to the other end through the torsion bar 30. Therefore, smooth operation is assured and the key 20 is not inclined or tilted and forces tending to dislodge or break the key switch 10 and the stem 13 are not created.

However, the above arrangement needs the keyboard chassis 50 for mounting the key switch and the torsion bar and hence it is complex in construction, takes a long time to assemble. As a result, the cost of the equipment increases and compactness and lightness of the equipment are compromised:

SUMMARY OF THE INVENTION

It is an object of the present invention to provide a keyboard switch of a simple and inexpensive structure which assures a positive operation of a rectangular key.

It is another object of the present invention to provide a keyboard switch having a common member for a support of stress transmitting means for transmitting a depression force of a key top mounted on a key switch to a plurality of areas of the key top, and engagement of the key switch.

It is another object of the present invention to provide an electronic part having a bent terminal and a positioning projection for positioning the part on a printed circuit board.

It still is another object of the present invention to provide a key switch having a common support member to a support of stress transmitting means for transmitting a depression force of a key top mounted on a key switch to a plurality of areas of the key top and a support of the key switch, and a bent terminal and a positioning projection for fixing the key switch.

It is yet another object of the present invention to provide a key switch in which a support for stress transmitting means for transmitting a depression force of a key top mounted on a key switch to a plurality of areas of the key top is integral with the key switch.

DETAILED DESCRIPTION OF THE PREFERRED EMBODIMENTS

Figure 1:
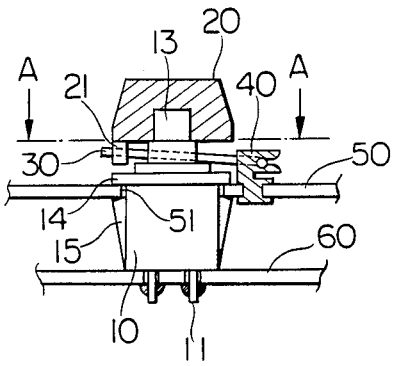
FIG. 1 PRIOR ART
FIGS. 1 and 2 are respectively a longitudinal sectional view and a cross-sectional view, taken from line A—A in FIG. 1, of a prior art keyboard switch.
Figure 2:
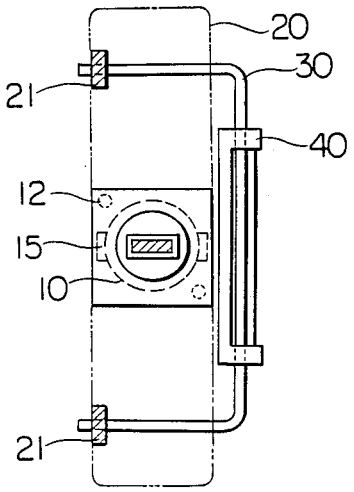
FIG. 2 PRIOR ART

In the following description of the preferred embodiments of the present invention, the like elements to those of the prior art structure shown in FIGS. 1 and 2 are designated by the like numerals and the explanation thereof is omitted.

Figure 3:
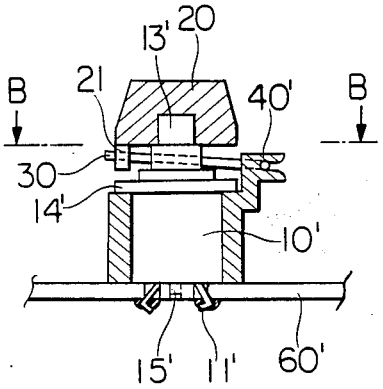
FIGS. 3 and 4 are respectively a longitudinal sectional view and cross-sectional view, taken from line B—B in FIG. 3, of a keyboard switch of the present invention.
Figure 4:
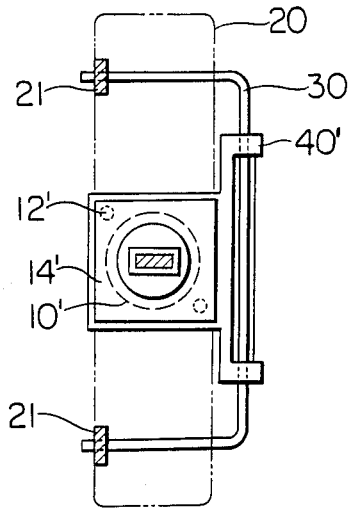

FIGS. 3 and 4 show a keyboard switch of the present invention. FIG. 4 shows a sectional view taken along a line B—B of FIG. 3. In the present invention, the torsion bar 30 is borne by a bracket 40' formed to cover a key switch 10'.

The keyboard chassis of the prior art structure is omitted and the key switch 10' is fixed to a printed circuit board 60' by soldering a terminal 11' thereto. Positioning relative to the printed circuit board 60' is done by fitting a positioning projection 15' formed at the bottom of the key switch 10' to a positioning hole formed in the printed circuit board 60'. As shown, the terminal 11' is bent so that the key switch 10' can be tentatively fixed to the printed circuit board 60'. A positioning projection 12', sometimes referred to hereinafter as a "fitting" member, at the bottom of a flange 14' of the key switch 10' is fitted to a positioning hole formed in the bracket 40' so that the key switch 10' is positioned to the bracket 40' and the torsion bar 30.

Structures of the bracket 40' and the key switch 10' are shown in detail in FIGS. 5A and 5B and FIGS. 6A and 6B.

Figure 5A:
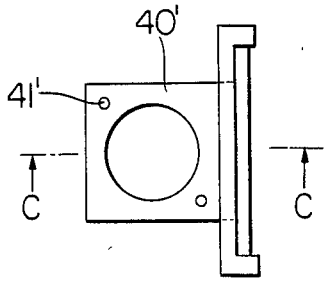
FIGS. 5A and 5B are respectively a top view and a longitudinal sectional view, taken from line C—C in FIG. 5A, of a bracket used in the keyboard of the present invention.
Figure 5B:
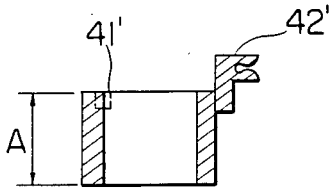

FIG. 5A shows a top view of the bracket 40' and FIG. 5B shows a sectional view taken along a line C—C of FIG. 5A. Numeral 41' denotes a positioning hole to which the positioning projection, or fitting member 12' is fitted, and numeral 42' denotes a bearing to which the torsion bar 30 is fitted.

Figure 6A:
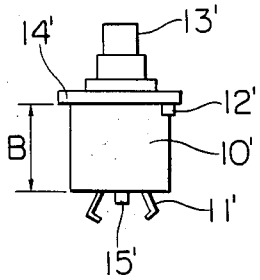
FIGS. 6A and 6B are a side elevational view and a bottom view, respectively, of the key switch of the present invention.
Figure 6B:
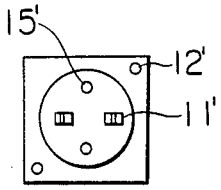

FIG. 6A shows a side elevational view of the key switch 10' and FIG. 6B shows a bottom view. Two positioning projections 15' are formed at the bottom of the key switch 10'. Terminals 11' are bent. In the structures shown in FIGS. 5A and 5B and FIGS. 6A and 6B, by designing a height A of the bracket 40' relative to a length B between a lower surface of the flange 14' of the key switch 10' and the bottom of the key switch 10' with an appropriate margin (for example, approximately 0.1 mm), the key switch 10', the bracket 40' and the torsion bar 30 can be mounted with proper positional relationship by the positioning members.

In assembling the keyboard switch, the bracket 40' is fitted to the key switch 10', then the positioning projection 15' and the terminal 11' are fitted to the mounting hole and the positioning hole formed on the printed circuit board 60' and the terminal 11' is soldered. Subsequently, the torsion bar 30 is mounted on the bearing 42' of the bracket 40', the torsion bar receptacle 21 of the key 20 is engaged with the end of the torsion bar 30, and the key 20 is fitted to the stem 13'.

As described hereinabove, according to the present invention, the keyboard chassis 50 which was necessary in the prior art structure can be omitted and the structure is simplified. Accordingly, the number of members to be positioned is reduced, the assembly work is simplified and the equipment can be reduced in size and weight. Since the torsion bar of the present invention is not positioned relative to the key 20 through the keyboard chassis, the assembly accuracy can be improved, the possibility of failure is reduced and positive operation is assured.

What I claim is:

1. A keyboard switch comprising:

a key switch;

a key top mounted on said key switch; stress transmission means for transmitting to a plurality of areas of said key top a depression force applied to said key top;

a common member which supports said stress transmission means and engages said key switch;

a flange fixed to said key switch; and a fitting member formed between said flange and said common member for positioning them relative to each other.

2. A key switch device comprising:

a key switch;

a key top mounted on said key switch;

a connecting member for transmitting a depression force applied to one portion of said key top to another portion of said key top in order to prevent said key top from inclining;

a common member which supports said connecting member and engages said key switch;

a fitting member for positioning said key switch device, said fitting member being disposed between said key switch and said common member;

an electrical terminal mounted on said key switch, said terminal being bent in such a shape as to enable tentative fixing of said key switch to a printed circuit board, to retain said key switch resiliently in position relative to the printed circuit board, when said key switch is assembled onto the printed circuit board; and a positioning projection fixed to said key switch for positioning said key switch relative to the printed circuit board.

3. An electronic device comprising:

a key switch including a flange and a terminal spaced apart from each other by a predetermined distance;

a printed circuit board comprising means for fixing said terminal of said key switch to said printed circuit board;

a key top, mounted on said key switch, comprising one pair of engagement portions spaced apart from each other, wherein said engagement portions are arranged along one side of said key top;

a common member comprising a first fitting portion and a second fitting portion, wherein said flange of said key switch is fitted to said first fitting portion and wherein said common member is supported between said flange and said printed circuit board by connecting said terminal to said means for fixing of said printed circuit board; and a connecting member for transmitting a depression force applied to one portion of said key top to another portion of said key top in order to prevent said key top from inclining, wherein a central portion of said connecting member is rotatably fitted to said second fitting portion of said common member and each of the vicinities of both sides of said connecting member is engaged to different ones of said engagement portions of said key top;

wherein said key top is prevented from inclining upon pressing a portion of said key top by transmitting said depression force which acts on one of said engagement portions to the other of said engagement portions through said connecting member.

4. An electronic device according to claim 3, wherein said connecting member is a torsion bar.

5. An electronic device comprising:

a key switch including an electrical terminal mounted thereon, said terminal being bent in such a shape so as to enable tentative fixing of said key switch to said printed circuit board, to retain said key switch resiliently in position relative to the printed circuit board when said key switch is assembled onto the printed circuit board;

a positioning projection fixed to said key switch for positioning said key switch relative to the printed circuit board;

a key top mounted on said key switch;

stress transmitting means for transmitting to a plurality of areas of said key top a depression force applied to said key top; and a common member that engages said key switch and that supports the stress transmitting means at first and second points that are spaced apart from each other by a distance greater than a dimension of said key switch in a direction perpendicular to a line between said first and second points.

6. An electronic device according to claim 5, further comprising a flange fixed to said key switch.

* * * * *

UNITED STATES PATENT AND TRADEMARK OFFICE

CERTIFICATE OF CORRECTION

PATENT NO. : 4,709,128

DATED : November 24, 1987

INVENTOR(S) : KAZUYOSHI ODAGAWA

It is certified that error appears in the above-identified patent and that said Letters Patent is hereby corrected as shown below:

AT [56] IN THE REFERENCES

Insert, --3,878,344 4/1975 Lockard 200/294
3,249,726 5/1966 Long 200/295
1,227,392 5/1961 France 200/294--.
Other Publications, "Mechanis-m-" should read --Mechanism---.

COLUMN 1

Line 31, "at center" should read --at the center--.
Line 67, "construction," should read --construction, and--.

COLUMN 2

Line 18, "still is" should read --is still--.
Line 20, "to" should read --for--.

UNITED STATES PATENT AND TRADEMARK OFFICE

CERTIFICATE OF CORRECTION

PATENT NO. : 4,709,128

DATED : November 24, 1987

INVENTOR(S) : KAZUYOSHI ODAGAWA

It is certified that error appears in the above-identified patent and that said Letters Patent is hereby corrected as shown below:

COLUMN 3

Line 50, switch; stress" should read --switch; ¶ stress--.

Signed and Sealed this

Nineteenth Day of April, 1988

*Attest:*

*Attesting Officer*

DONALD J. QUIGG

*Commissioner of Patents and Trademarks*